United States Patent [19]

Schulze et al.

[11] Patent Number: 4,997,036

[45] Date of Patent: Mar. 5, 1991

[54] HEAT EXCHANGER TUBE

[75] Inventors: Heinrich Schulze, Sprockhövel; Paul Paikert, Witten, both of Fed. Rep. of Germany

[73] Assignee: GEA Luftkühlergesellschaft Happel GmbH & Co., Bochum, Fed. Rep. of Germany

[21] Appl. No.: 391,504

[22] PCT Filed: Nov. 2, 1988

[86] PCT No.: PCT/DE88/00678

§ 371 Date: Jun. 29, 1989

§ 102(e) Date: Jun. 29, 1989

[87] PCT Pub. No.: WO89/04447

PCT Pub. Date: May 18, 1989

[30] Foreign Application Priority Data

Nov. 3, 1987 [DE] Fed. Rep. of Germany ..... 3737217

[51] Int. Cl.[5] ..... F28F 1/30

[52] U.S. Cl. ..... 165/182; 165/151; 165/181

[58] Field of Search ..... 165/151, 181, 182

[56] References Cited

U.S. PATENT DOCUMENTS

| | | | |
|---|---|---|---|
| 1,743,861 | 1/1930 | Modine | 165/151 |
| 3,976,126 | 8/1976 | Ruff | 165/110 |

FOREIGN PATENT DOCUMENTS

| | | | |
|---|---|---|---|
| 417271 | 6/1924 | Fed. Rep. of Germany | 165/152 |
| 329582 | 6/1900 | France | 165/151 |
| 715051 | 11/1931 | France | 165/182 |
| 61-91493 | 5/1986 | Japan . | |
| 61-272593 | 12/1986 | Japan | 165/151 |
| 321820 | 11/1929 | United Kingdom | 165/151 |
| 842475 | 7/1960 | United Kingdom | 165/182 |

*Primary Examiner*—Martin P. Schwadron
*Assistant Examiner*—Allen J. Flanigan
*Attorney, Agent, or Firm*—Toren, McGeady & Associates

[57] ABSTRACT

Essentially triangular turbulators 3 extending at an angle α to the tube longitudinal plane RLE running through the tube axis RA as well as parallel to the fluid flow direction FSR are arranged on the flat lateral ribs 2 of a heat exchanger tube 1. The turbulators 3 are stamped out of the rib plane and are then bent off at an angle of approximately 90°. They have flash or parting lines 4 rising in the fluid flow direction FSR as well as in the direction of the heat exchanger tube 1. This allows generation of longitudinal vortices 5 downstream of the turbulators 3 which roll over the boundary layers in this location and improve the heat transfer.

10 Claims, 2 Drawing Sheets

HEAT EXCHANGER TUBE

BACKGROUND OF THE INVENTION

The invention is directed to a heat exchanger tube with flat lateral ribs spaced uniformly from each other in longitudinal direction.

In order to improve the heat exchange conditions at the transverse ribs, turbulators (vortex or turbulence generators) projecting at right angles from the surfaces of the lateral ribs have been provided, which turbulators protrude into fluid flow. These turbulators have a rectangular cross-section. They are stamped out of the material of the lateral ribs and are subsequently bent over or folded. The direction of their extent runs parallel to the direction of the fluid flow.

The heat exchange conditions can be distinctly improved by these turbulators compared to transverse ribs without projections. The disadvantage however is an overproportionate pressure loss as compared to the improved heat transfer.

SUMMARY OF THE INVENTION

The invention is based upon the task of taking all necessary measures permitted to avoid an overproportional rise of the pressure loss at improved heat transfer conditions.

In accordance with the present invention, the heat exchanger tube has turbulators or longitudinal vortex generators projecting from the rib plane by approximately 90°. The turbulators are essentially triangularly shaped with unequal sides and extend at an angle with respect to the fluid flow direction. The turbulators are provided in a distributed arrangement at an angle with respect to the tube longitudinal plane which extends through the tube axis as well as parallel to the fluid flow direction. The turbulators have parting lines which rise in fluid flow direction as well as in the direction of the tube surface.

Because of such a special design and arrangement of the turbulators the fluid is twisted downstream of them viewed in flow direction and indeed in such a manner that longitudinal vortices or longitudinal turbulence is generated there. The boundary layer adjacent to the ribs, which essentially constitutes the thermal resistance can, so-to-speak, be rolled over with a relatively minor energy expenditure with the help of these longitudinal vortices. Herein the warm or cold fluid layers near the ribs are continuously replaced by the cold or warm fluid layers remote from the ribs by the generated pronounced rotation of the flow perpendicularly to the fluid flow direction. The longitudinal vortices, extremely low in friction, cause downstream of the turbulators regions with locally considerably improved heat transfer conditions, so that overall the heat transfer coefficient is clearly increased without a simultaneous rise of the pressure loss.

The turbulators in the invention develop their advantageous effects with any cross-section of heat exchanger tubes. This means they can be used with round elliptical or wedge-shaped ribbed tubes.

An especially intensive longitudinal vortex is generated downstream of each turbulator because the parting line of each turbulator rises in fluid flow direction. The longitudinal vortex extends far into the fluid flow.

Another improvement of the basic concept of the invention resides in the fact that the turbulators are arranged to be offset with respect to each other in the fluid flow direction as well as transversely to the fluid flow direction.

The offset or stagger is arranged herein in such a manner that the longitudinal vortices do not influence each other in a disadvantageous manner. Since the parting line of each turbulator also tilts in the direction of the tube outer surface, the heat passage between the fluid flowing in the tube and the fluid flowing around the ribbed tube is improved.

In this connection it was seen during in house experiments that the heat transfer can be further improved when the angle between the turbulators and the tube longitudinal plane is 10–30°, preferably approximately 15°.

In accordance with a preferred embodiment of the turbulators the ratio of the length of the turbulators to the maximum height thereof is approximately 3:2 to 3:1, preferably 3:1.75. This determines the appropriate stamped shapes in the lateral ribs. This form of the stamped out shapes is considered to be the optimum compromise between the following partially contradictory requirements:

(a) high local heat transfer coefficients,
(b) minimum impairment of the heat flow inside of a lateral rib,
(c) low pressure losses,
(d) simple fabrication,
(e) dip or immersion galvanizing without problems.

When the maximum height of the turbulators corresponds approximately to the rib spacing, penetration of the turbulators into the boundary layer of the adjacent lateral rib is made possible. As part of the breaking up of the boundary layer it is achieved by way of a further advantage, that a solid connection of the turbulators with the adjacent lateral rib is assured during the immersion galvanizing performed as a rule. In addition, the heat exchange technology properties of the exchange surface at the turbulators are improved because of the now more favorable rib efficiency (half the height). We mean by this that the heat can flow out of the turbulators in direction of both adjacent ribs or in reverse.

In accordance with another feature of the invention, the turbulators include an angle of less than 90° with the surfaces of the lateral ribs. This provides the advantage that the turbulators can be used directly for the spacing of two adjacent lateral ribs. Herein it suffices to undercut only a portion of the turbulators in their front edges.

In accordance with another feature, the turbulators are arranged symmetrically on both sides with respect to the tube longitudinal plane. This design and arrangement of the turbulators facilitates their fabrication.

The turbulators can be bent off out of a lateral rib only on one side or on both sides. Favorable pressure differences are achieved when the longitudinal vortex generators are arranged in pairs alternately on both sides of a lateral rib. This results in suction- and blowout effects, having a positive effect upon the boundary layer formation, meaning they reduce the thicknesses of the boundary layer.

In case of heat exchanger tubes permitting flow coming towards them from two diametrically opposed directions, there exists the possibility of arranging the turbulators in mirror image fashion with respect to the vertical longitudinal plane, in order to create optimum heat transfer conditions especially with round or oval heat exchanger tubes on the side meeting the flow coming towards them. The turbulators can then be designed as equilateral triangles or triangles with unequal sides.

In the following the invention is described with particularity with the help of embodiment examples depicted in the drawings.

DESCRIPTION OF THE PREFERRED EMBODIMENTS

Figure 1:
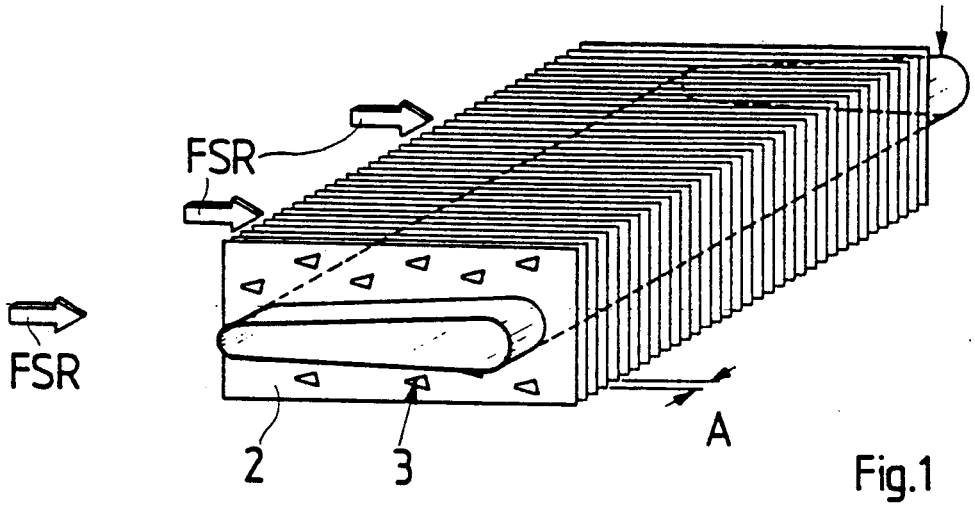
FIG. 1 shows a longitudinal portion of a ribbed wedge-shaped heat exchanger tube in perspective.
Figure 2:
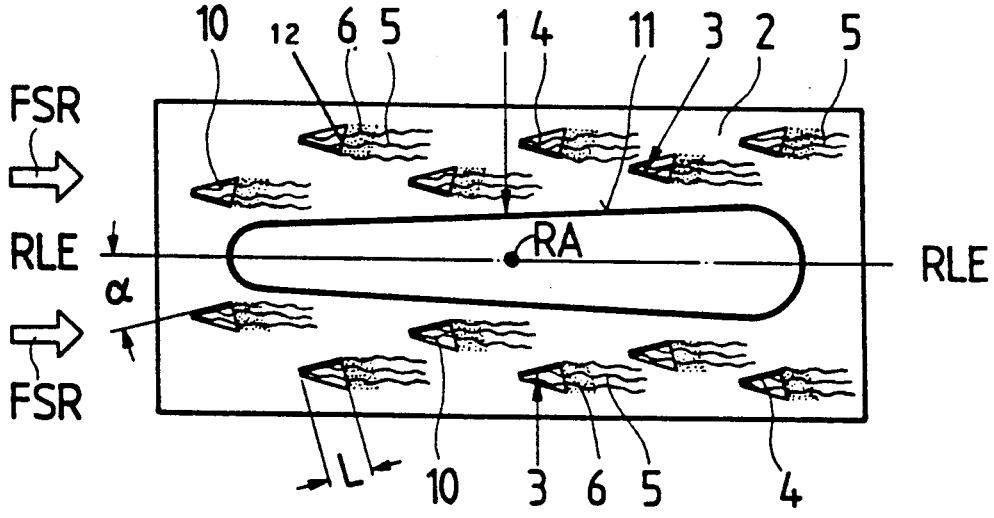
FIG. 2 is a front view upon the heat exchanger tube in FIG. 1.

A wedge-shaped exchanger tube is designated with the numeral 1 in FIGS. 1 and 2; a vapor-type fluid is flowing inside this tube and a colder gaseous fluid is flowing outside this tube in direction of the arrows FSR.

The heat exchanger tube 1 is equipped with a plurality of flat lateral ribs 2 arranged so as to be spaced next to each other at a distance A. The lateral ribs 2 are designed to be rectangular.

Lateral ribs 2 are fastened upon the heat exchanger tube by means of dip galvanizing.

Figure 3:
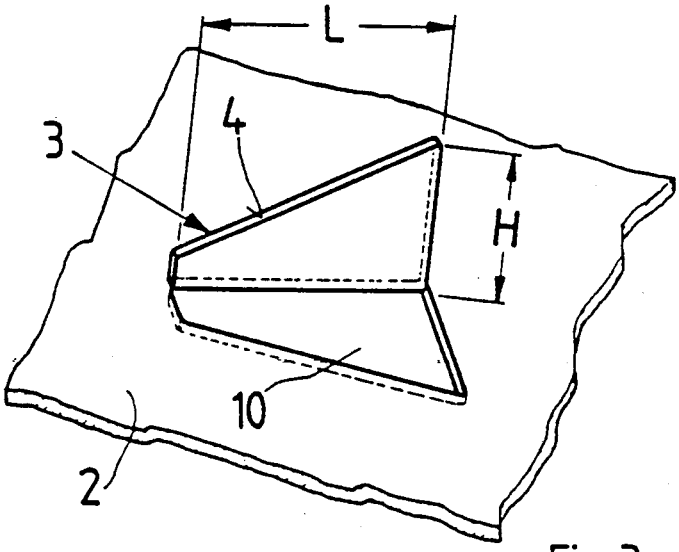
FIG. 3 shows a surface region of a lateral rib with a turbulator in magnified perspective presentation.

Turbulators or vortex generators 3 are bent off the lateral ribs 2 (FIGS. 1 to 3) in order to improve the heat transfer conditions. The turbulators 3 have essentially a triangular cross-section with unequal sides and are formed by stamping and bending through approximately 90° from the plane of the rib. They extend at an angle $\alpha$ of 15° to the tube longitudinal plane RLE running through the tube axis RA as well as parallel to the direction of fluid flow FSR. In addition they have flash or parting lines 4 rising in fluid flow direction FSR as well in the direction toward the tube surface 11. The lengths L of the turbulators 3 is dimensioned at a ratio 3:1.75 to their maximum height H. The maximum height corresponds approximately to the rib spacing A.

As can be discerned especially from FIG. 2, the turbulators 3 are offset with respect to each other in as well as transversely to the fluid flow direction FSR. FIG. 2 shows only that the turbulators are arranged symmetrically on both sides with respect to the tube longitudinal plane RLE.

Longitudinal vortices 5 with low friction are generated by the turbulators 3, thus assuring a high local heat transfer downstream of the turbulators 3. Because of their pronounced twist they break up the boundary layer at the lateral ribs 2 and roll it over, wherein the warm or cold fluid layers near the ribs are continuously replaced by the cold or warm fluid layers remote from the ribs.

The thinned-out boundary layer regions formed by the impingement edges 12 of the stamped-out regions 10 are designated by 6.

Figure 4:
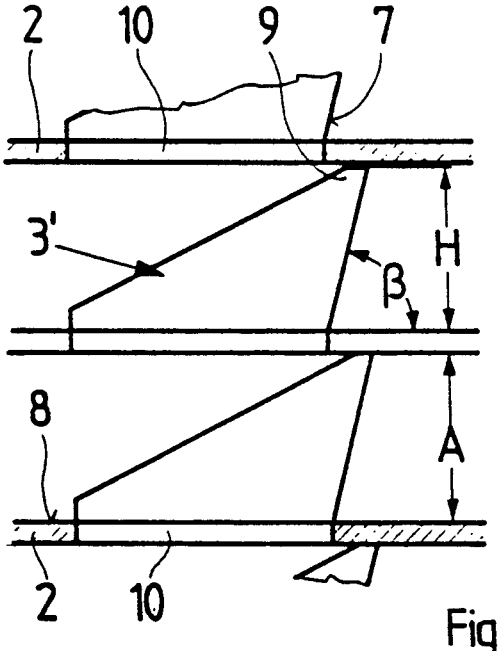
FIG. 4 shows the region between three adjacent lateral ribs with turbulators according to an additional embodiment form.

An embodiment example is depicted in FIG. 4 where the front edges 7 of the turbulators 3' enclose an angle $\alpha<90°$ with the surfaces 8 of the lateral rib 2. This embodiment form permits a utilization of the turbulators 3' for spacing of adjacent lateral ribs 2, since the tips 9 of the turbulators 3' come to rest outside of the stamped out region 10 because of the undercuts at the adjacent lateral rib 2.

We claim:

1. Heat exchanger tube with flat lateral ribs spaced uniformly with respect to each other in a longitudinal direction, comprising longitudinal vortex generators projecting from the rib plane by approximately 90°, which are essentially triangularly shaped with unequal sides and extend at an angle with respect to a fluid flow direction, the heat exchanger tube having a tube longitudinal plane (RLE) running through the central axis (RA) as well as parallel to the fluid flow direction (FSR), the longitudinal vortex generators (3, 3') being provided in a distributed arrangement at an angle ($\alpha$) with respect to the tube longitudinal plane (RLE), wherein the longitudinal vortex generators comprise parting lines (4) rising in fluid flow direction (FSR) as well in the direction to the tube surface (11), the heat exchanger tube having leading and trailing edges relative to the fluid flow direction, at least some of said vortex generators lying between said leading and trailing edges.

2. Heat exchanger tube according to claim 1, wherein the longitudinal vortex generators (3, 3') are arranged to be offset with respect to each other in the fluid flow direction (FSR) as well as transversely to the fluid flow direction (FSR).

3. Heat exchanger tube according to claim 1 or 2, wherein the angle ($\alpha$) between the longitudinal vortex generators (3, 3') and the tube longitudinal plane (RLE) is 10° to 30°.

4. Heat exchanger tube according to claims 1 or 2, wherein the length (L) of the longitudinal vortex generators (3, 3') is their maximum height (H) approximately 3:2 to 3:1.

5. Heat exchanger tube according to claims 1 or 2, wherein the maximum height (H) of the longitudinal vortex generators (3, 3') corresponds approximately to the rib spacing (A).

6. Heat exchanger tube according to claims 1 or 2, wherein the longitudinal vortex generators (3') have front edges (7) which include an angle ($\beta$)$<90°$ with the surfaces (8) of the lateral ribs (2).

7. Heat exchanger tube according to claims 1 or 2, wherein the longitudinal vortex generators (3, 3') are arranged symmetrically on both sides with respect to the tube longitudinal plane (RLE).

8. Heat exchanger tube according to claims 1 or 2, wherein the longitudinal vortex generators (3, 3') are arranged in pairs alternately on both sides of a lateral rib (2).

9. Heat exchanger tube according to claim 3, wherein the angle ($\alpha$)is preferably approximately 15°.

10. Heat exchanger tube according to claim 4, wherein the length (L) to the maximum height (H) is preferably 3:1.75.

* * * * *